US006685523B2

(12) United States Patent
Kim et al.

(10) Patent No.: US 6,685,523 B2
(45) Date of Patent: Feb. 3, 2004

(54) METHOD OF FABRICATING CAPILLARY DISCHARGE PLASMA DISPLAY PANEL USING LIFT-OFF PROCESS

(75) Inventors: Steven Kim, Harrington Park, NJ (US); Geun Young Yeom, Seoul (KR); Young-Joon Lee, Seoul (KR)

(73) Assignee: Plasmion Displays LLC, Roanoke, VA (US)

( * ) Notice: Subject to any disclaimer, the term of this patent is extended or adjusted under 35 U.S.C. 154(b) by 84 days.

(21) Appl. No.: 09/885,135

(22) Filed: Jun. 21, 2001

(65) Prior Publication Data

US 2002/0058209 A1 May 16, 2002

Related U.S. Application Data

(60) Provisional application No. 60/248,007, filed on Nov. 14, 2000.

(51) Int. Cl.[7] ..... H01J 9/24

(52) U.S. Cl. ..... 445/24; 445/22; 445/23; 445/25; 445/26; 313/587; 313/581; 313/586

(58) Field of Search ..... 445/23, 24, 25, 445/22, 6, 50, 51, 52; 313/587, 581, 586, 582, 584

(56) References Cited

U.S. PATENT DOCUMENTS

| | | | | |
|---|---|---|---|---|
| 5,209,687 | A | * | 5/1993 | Konishi |
| 6,097,149 | A | * | 8/2000 | Miyaji et al. |
| 6,242,860 | B1 | * | 6/2001 | Sasao et al. |
| 6,353,287 | B1 | * | 3/2002 | Sasaki et al. |
| 2001/0015623 | A1 | * | 8/2001 | Takada et al. |
| 2001/0052753 | A1 | * | 12/2001 | Jo |
| 2002/0175622 | A1 | * | 11/2002 | Otani et al. |

* cited by examiner

*Primary Examiner*—Anthony Dinkins
*Assistant Examiner*—Nguyen T. Ha
(74) *Attorney, Agent, or Firm*—Morgan, Lewis & Bockius LLP

(57) ABSTRACT

A method for fabricating a PDP is disclosed. The method for fabricating a PDP including the steps of preparing first and second panels for connecting with each other, forming at least one electrode on the first panel, forming a dielectric layer of PbO on the first panel, sequentially forming Cr and Ni on the PbO layer as a mask material of the PbO layer, performing photolithography and lift-off processes on the Ni/Cr layers to form a mask pattern of Ni/Cr, and etching the PbO layer using the mask pattern of Ni/Cr to form at least one capillary tube within the PbO layer to expose the electrode.

19 Claims, 17 Drawing Sheets

FIG. 8

| | gas chemistry | power/ bias voltage | pressure | total flow rate | electro magnet | substrate temperature (°C) | etch rate (A/min) |
|---|---|---|---|---|---|---|---|
| | $Cl_2$ +20%$BCl_3$ | 600/−200 | 10 | 30 | ✕ | normal temperature | 230 |
| | $Cl_2$ +20%$BCl_3$ | 600/−200 | 10 | 30 | ○ | normal temperature | 315 |
| | $Cl_2$ +20%$BCl_3$ | 600/−200 | 10 | 60 | ○ | 70 | 594 |
| | $Cl_2$ +20%$BCl_3$ | 600/−200 | 10 | 60 | ○ | 70 | 520 |
| | $Cl_2$ +20%$BCl_3$ | 600/−200 | 5 | 30 | ○ | 70 | 870 |
| | $Cl_2$ +20%Ar | 600/−200 | 10 | 60 | ○ | 70 | 549.5 |
| | $Cl_2$ +50%Ar | 600/−200 | 10 | 60 | ○ | 70 | 630 |
| | $C_2$ +20%HBr | 600/−200 | 10 | 60 | ○ | 70 | 568 |
| | $Cl_2$ +50%HBr | 600/−200 | 10 | 60 | ○ | 70 | 495 |
| | $C_2$+80%HBrl | 600/−200 | 10 | 60 | ○ | 70 | 293 |

FIG. 11

| | work | process(Condition) | note |
|---|---|---|---|
| #1 | coat | a.low-500rpm | whole treatment: HMDS<br>PR thickness:about1.8μm |
| | | b.high-2000rpm | |
| #2 | pre-bake | 80-90°,15min | |
| #3 | exposure | 10mW,20sec | |
| #4 | image reverse back | 110°C,15min | |
| #5 | post exposure | 10mW,10min | whole surface exposure (image reverse) |
| #6 | develop | AZ 300MIF,50sec~60sec | |
| #7 | post-bake | 120°C,10min | |

METHOD OF FABRICATING CAPILLARY DISCHARGE PLASMA DISPLAY PANEL USING LIFT-OFF PROCESS

This application claims the benefit of a provisional application, entitled "Method of Fabricating capillary Electrode Discharge Plasma Display Panel Using Lift-Off Process," which was filed on Nov. 14, 2000, and assigned Provisional Application No. 60/248,007, which is hereby incorporated by reference.

BACKGROUND OF THE INVENTION

1. Field of the Invention

The present invention relates to a plasma display panel (PDP), and more particularly, to a method of fabricating a capillary discharge plasma display panel using a lift-off process. Although the present invention is suitable for a wide scope of applications, it is particularly suitable for forming capillaries in the plasma display panel, thereby generating a high-density plasma discharge.

2. Discussion of the Related Art

Generally, gas discharges have been used to convert electrical energy into light in a plasma display panel (PDP). Each pixel of the PDP corresponds to a single signal gas discharge area, and light discharged from each pixel is electrically controlled by an image signal that displays an image.

While various structures for a color PDP have been suggested since the 1980's, only three structures among them are currently under study. These three structures are an alternating current matrix sustain structure, an alternating current coplanar sustain structure, and a direct current driving structure having a pulse memory.

In flat panel display technologies, the PDP is generally adopted in a large size display device having a diagonal length of 40 inches or greater. Various studies have been conducted to reduce response time, lower a driving voltage, and improve luminance, since a prototype PDP was developed. Reduced response time, lower driving voltage, and improved luminance can be achieved by maximizing discharge efficiency of ultraviolet rays from glow discharge.

A capillary discharge plasma display panel (CDPDP) having a reduced response time, a lower driving voltage, and a higher luminance was disclosed in the U.S. patent application Ser. No. 09/108,403, as shown in FIG. 1. The CDPDP includes a first substrate 11, a second substrate 12, and a first electrode 13 formed on the first substrate 11. A second electrode 14 is formed on the second substrate 12. A pair of barrier ribs 15 connect the first substrate 11 with the second substrate 12. A discharge region 16 is defined between the first substrate 11 and the second substrate 12 by the barrier ribs 15. A dielectric layer 17 is formed on the first substrate 11 including the first electrode 13. The dielectric layer 17 has at least one or more capillaries 18 for providing a steady state discharge of ultraviolet (UV) rays in the discharge region 16. The capillary 18 exposes the first electrode 18 toward the discharge region 21. The aforementioned CDPDP generates a high-density plasma through the capillary. The number of the capillary and its diameter may be varied to optimize a discharge characteristic.

Referring back to FIG. 1, in forming a capillary in the dielectric layer 22, any one of laser etching, wet etching, and dry etching methods may be used. However, it is required using optimal etching conditions such as a material of the dielectric layer, a mask material, etching method, and process conditions. If the optimum etching conditions are not used, it is difficult to form a desired capillary.

Laser etching, for example, has a drawback in a high cost and a processing time because laser optics should be used in this process. Also, because the laser etching is a physical etching method that provides no etching selectivity, the capillaries are not uniformly etched. In other words, some capillaries are formed while others are not formed as desired.

Further, since wet etching has an isotropic etching characteristic, it is impossible to obtain an exact diameter of as intended. Accordingly, it is required obtaining optimum etching conditions by repeating experiments.

SUMMARY OF THE INVENTION

Accordingly, the present invention is directed to a method of fabricating a capillary discharge plasma display panel using a lift-off process that substantially obviates one or more of the problems due to limitations and disadvantages of the related art.

An object of the present invention is to provide a method of fabricating a capillary discharge plasma display panel in forming capillaries in the dielectric layer.

Another object of the present invention is to provide a method of fabricating a capillary discharge plasma display panel to improve yield as well as reduce a production cost.

Still another object of the present invention is to provide a method of fabricating a capillary plasma display panel in which a driving voltage is lowered and a response time is shortened.

Still another object of the present invention is to provide a method of fabricating a capillary plasma display panel that provides a high-density UV discharge.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings:

FIG. 8 is a table showing variation of an etching rate of a Ni film when the Ni film is etched using magnetization induced combination plasma;

FIG. 11 is a table showing process conditions of AZ 5214E picture inverted polysilicon type photoresist in accordance with the present invention;

DETAILED DESCRIPTION OF THE PREFERRED EMBODIMENTS

Reference will now be made in detail to the preferred embodiments of the present invention, examples of which are illustrated in the accompanying drawings.

In the present invention, a dry etching method is elected to form capillaries by patterning a dielectric layer. It is preferable to use a dielectric layer having a high dielectric constant at the normal frequency of about 10 kHz to 150 kHz and a high breakdown voltage. In the present invention, PbO is used for a dielectric layer suitable for the above conditions.

PbO is a suitable material for forming capillaries but is difficult to be patterned. In other words, since PbO has a low vapor pressure, an etching rate is very low. PbO having a thickness of 10 $\mu$m is required to form capillaries. However, it is not easy to etch PbO having such a thickness. Moreover, to pattern PbO, a hard mask is generally required. The hard mask has a thickness proportional to that of the dielectric layer. Accordingly, it is difficult to pattern a mask material only. Consequently, to etch Pb, the mask material and its thickness are important factors in forming capillaries.

In the present invention, a double layer of Ni/Cr is used as a mask material for PbO having preferred conditions of the dielectric layer. Also, to form a mask of Ni/Cr, a lift-off process is used as a process for patterning Ni/Cr.

Efforts that can support efficiency of the conditions according to the present invention will now be described in detail.

Figure 1:
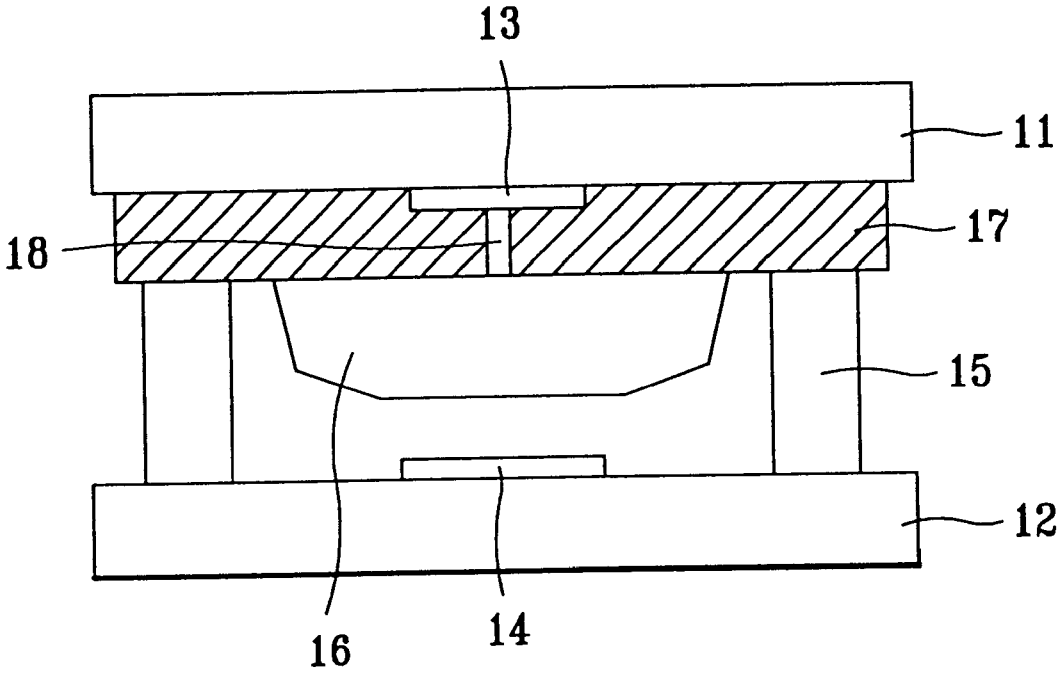
FIG. 1 is a cross-sectional view illustrating a capillary discharge plasma display panel disclosed in U.S. patent application Ser. No. 09/108,403.
Figure 2:
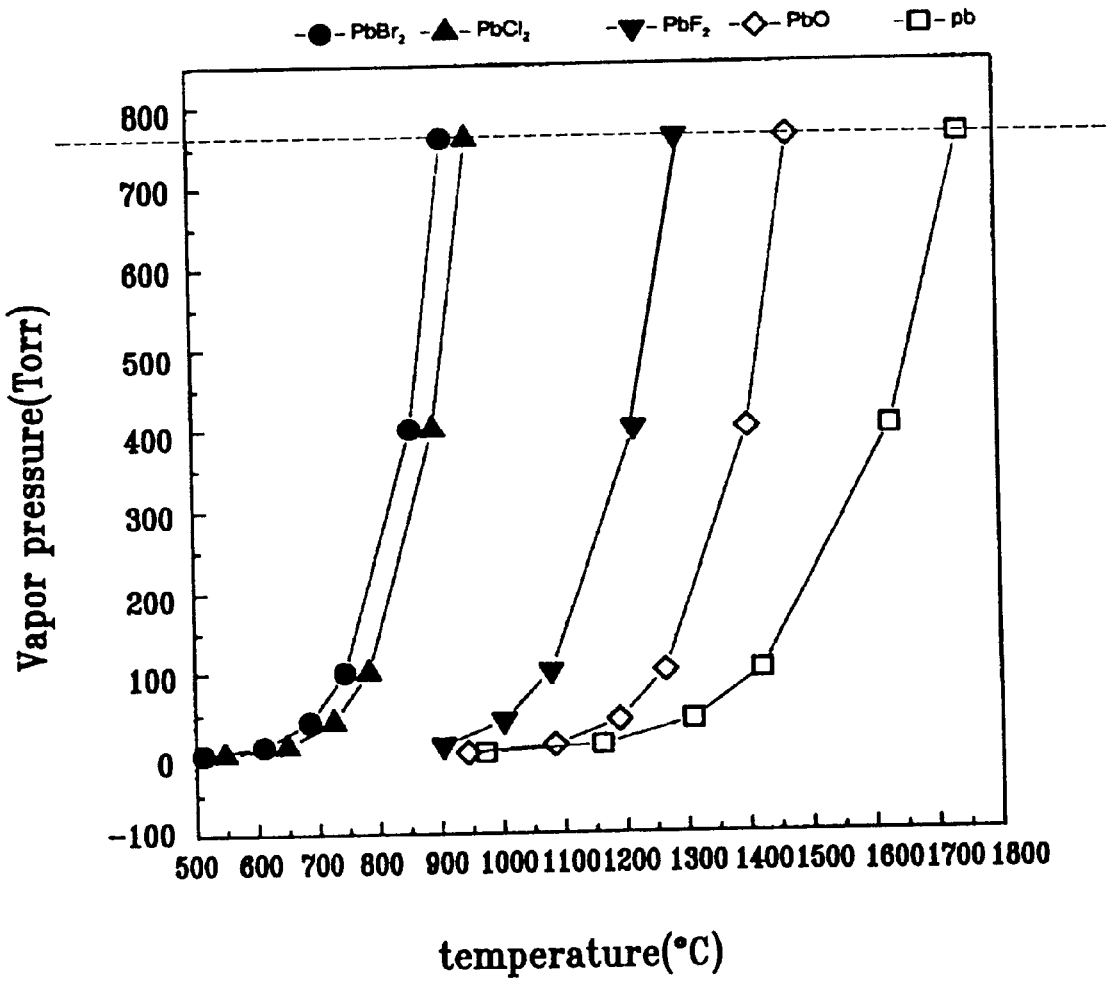
FIG. 2 illustrates that vapor pressure of Pb based materials varies with temperature.

FIG. 2 is a graph showing vapor pressure characteristics of PbO materials with temperature changes. PbO is mixed with various halogen gases such as Cl, F, and Br during a dry etching process using plasma, so that various etching by-products are generated. However, the mixtures represent a low vapor pressure of 1 atmospheric pressure or below at a high temperature, as shown in FIG. 2. Also, melting points of the respective compounds such as $PbBr_2$, $Pbcl_2$, $PbF_2$, PbO and Pb are respectively 373° C., 501° C., 855° C., 890° C., and 327.5° C., respectively.

Meanwhile, the PbO film having a thick thickness has a low vapor pressure and is difficult to etch. In the present invention, factors such as a heating effect in the panel temperature, an additive gas effect, a magnetic field effect and new mask materials are considered to improve an etching rate and an etching selectivity.

To obtain the heating effect in the panel temperature, in the present invention, a chiller is provided to enhance reactivity by increasing a temperature of the panel from a room temperature to 70° C.

To obtain the additive gas effect, the process conditions capable of sufficiently etching PbO of 7 $\mu$m is determined even if a pure $CF_4$ gas is only used.

To obtain the magnetic field effect, plasma is magnetized by using an electromagnet within a reaction chamber. The magnetic field effect consequently improves an etching effect.

A new mask material should be determined within the range that a thickness of the mask is not thicker than that of an etching material. Accordingly, in the present invention, a new mask material having an etching selectivity almost similar to Cr has been found.

In the present invention, upon etching PbO considering etching factors such as an inductive power, a bias voltage and an operation pressure using magnetization induced combination plasma, a bias voltage is more dependent than an inductive power at a low pressure. Accordingly, in the present invention, the pressure is fixed at 7 mTorr and the bias voltage is unchanged at −200 V.

Figure 3:
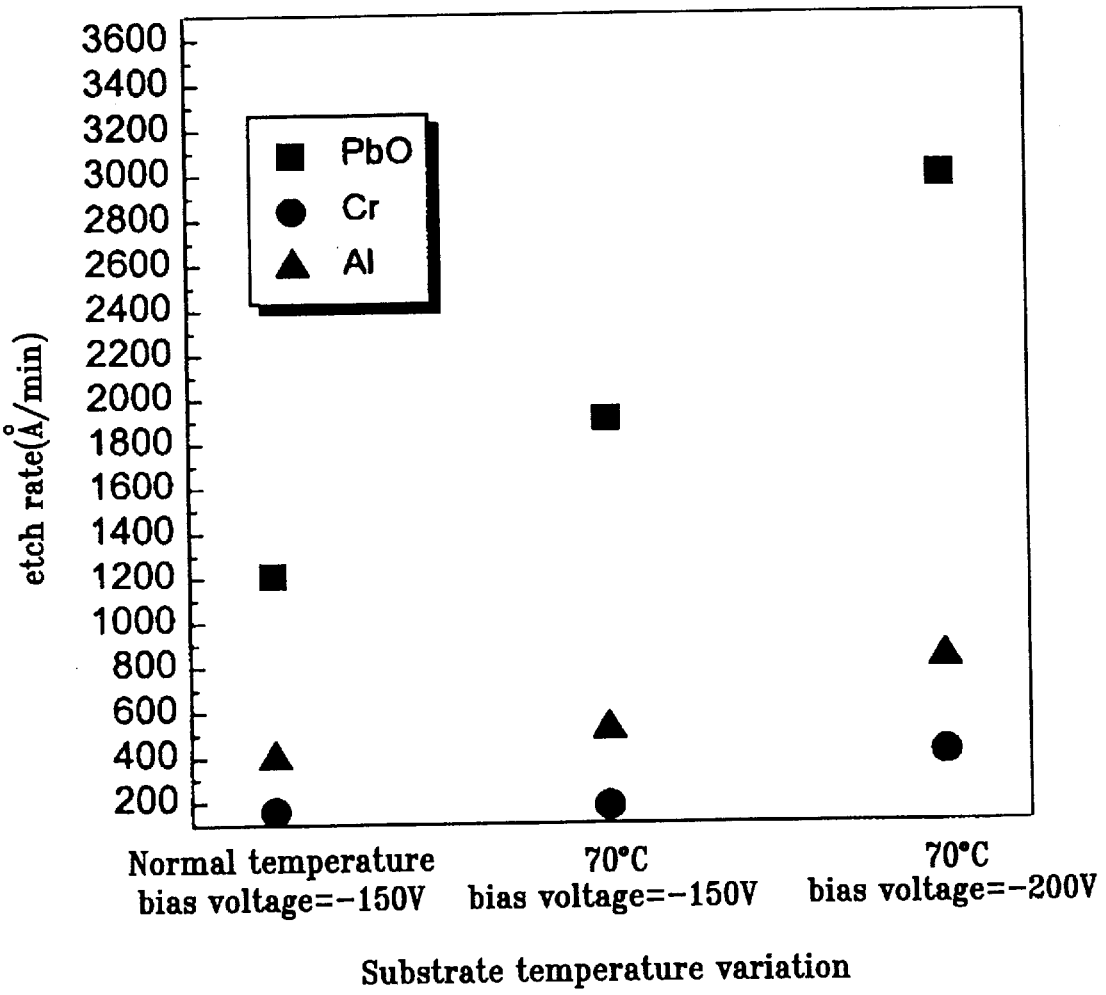
FIG. 3 illustrates variations in etching rates of PbO, Cr, and Al films when the temperature of the panel is varied.
Figure 5:
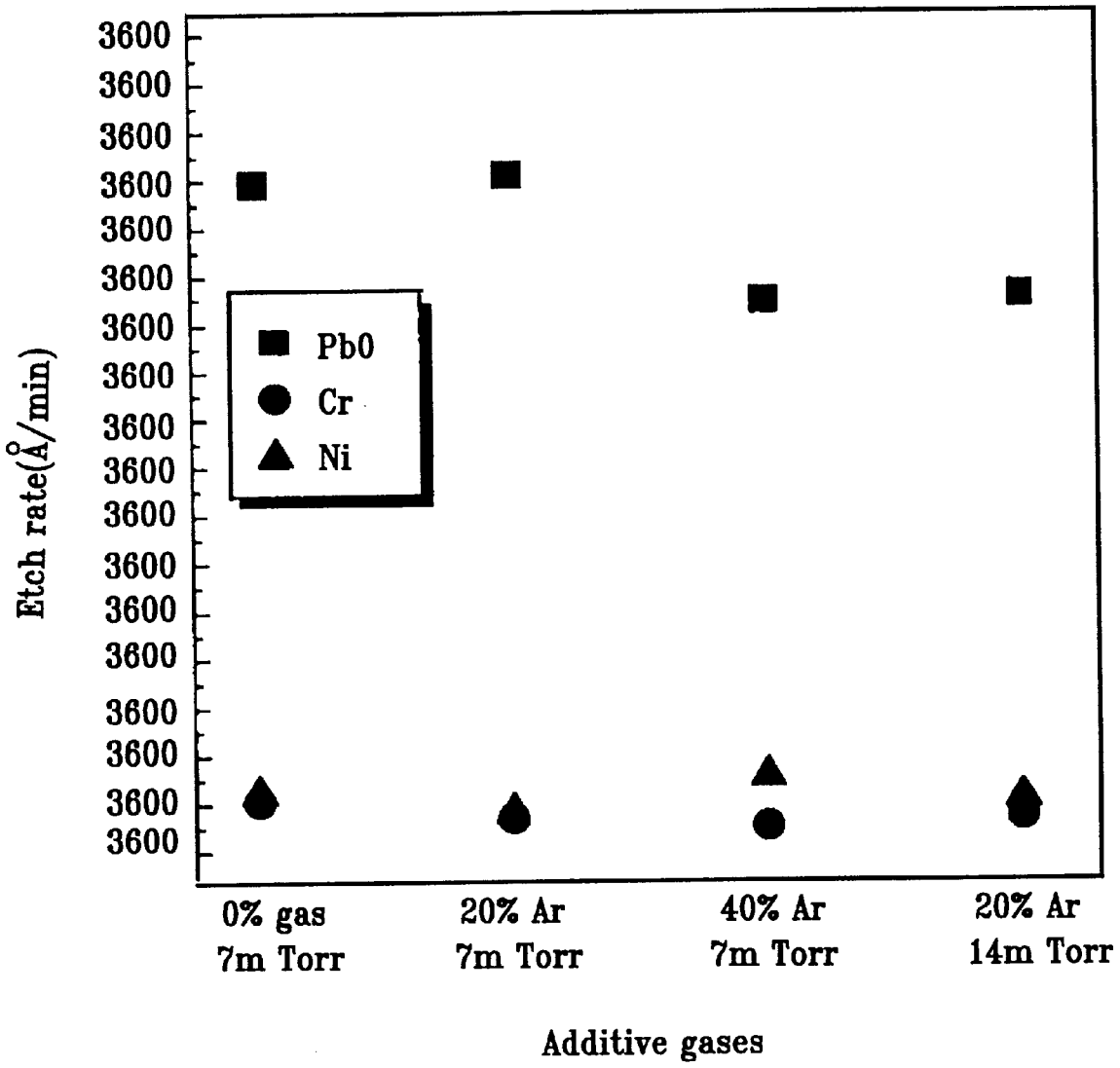
FIG. 5 illustrates variations in etching rate of PbO, Cr, and Al films when an amount of Ar gas and a process pressure are varied.

FIG. 5 is a graph showing variation of an etching rate of the PbO film with changes in the panel temperature using magnetization induced combination plasma. According to the process conditions corresponding to FIG. 3, a process pressure is 7 mTorr, an etch gas is pure $CF_4$, an inductive power is 900 W, and a bias voltage is −150 V and −200 V. In FIG. 3, when the panel temperature increases from the room temperature to 70° C., the etching rate increases by about 700 Å per minute. When the bias voltage is −200 V and the panel temperature is 70° C., the etching rate increases by about 1500 Å per minute. These results have been observed even in cases where chlorine based etching gas and magnetization induced combination plasma have been used. Therefore, when the intensity of the electromagnet is about 20 gauss, the etching rate is 2145 Å per minute at the room temperature and increases by about 3500 Å per minute at 70° C.

However, in case where chlorine based etching gas is used, an etching selectivity with a metal layer using as a mask film becomes poor. Accordingly, it would be better that fluoric based gas is used as an etching gas using magnetization induced combination plasma.

Figure 4:
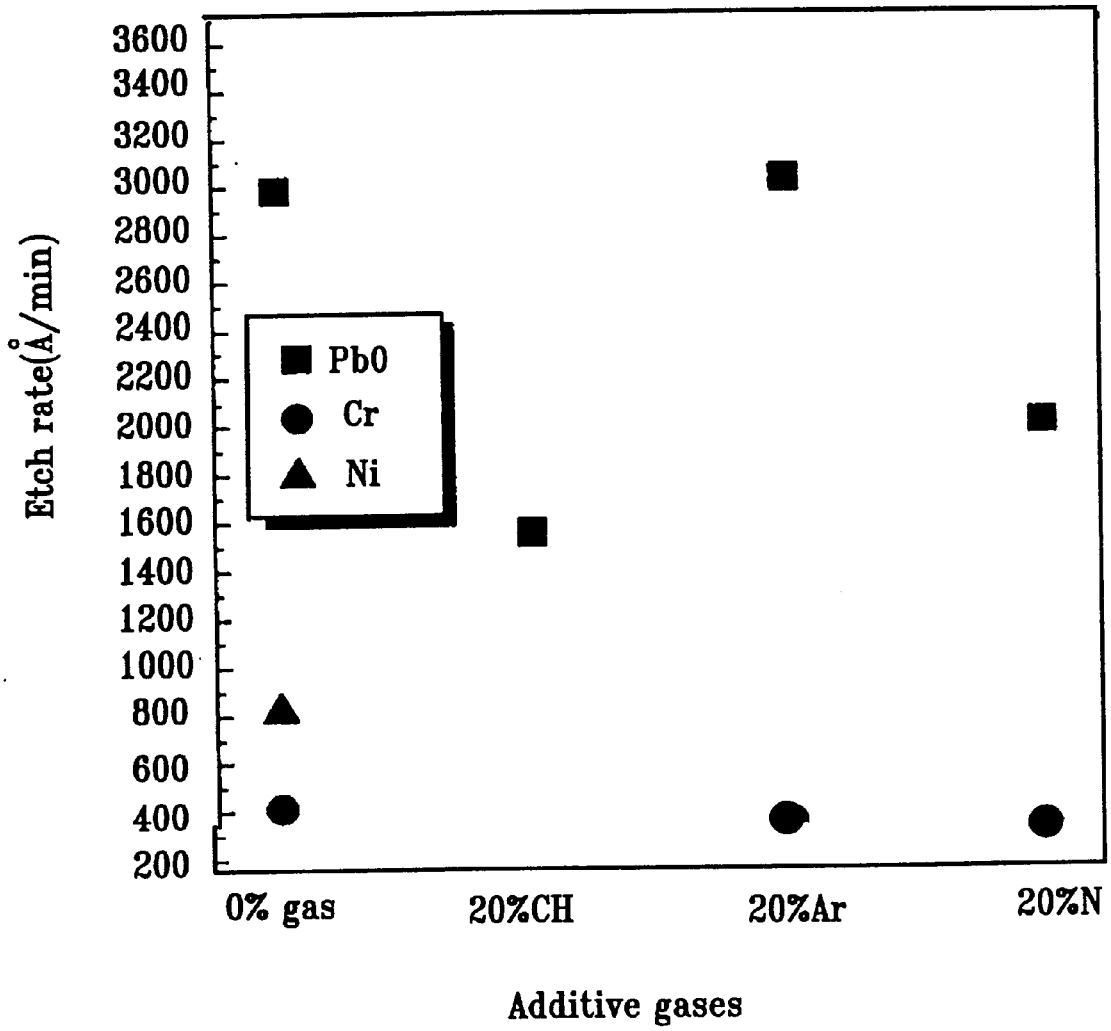
FIG. 4 illustrates variations in etching rates of PbO, Cr, and Al films when different additive gases are used with $CF_4$ as a main etching gas.

FIG. 4 is a graph showing variations in etching rate of PbO, Cr, and Ni layers according to variations in additive gases when $CF_4$ is used as a main etching gas. According to the process conditions of FIG. 4, a process pressure is 7 mTorr, an inductive power is 900 W, a bias voltage is −200 V, and a panel temperature is 70° C.

FIG. 5 is a graph showing variations in etching rate of PbO, Cr, and Ni layers according to an amount of $CF_4$+Ar additive gases and variation in the process pressure or flow rate. According to the process conditions corresponding to FIG. 7, a process pressure is 7 mTorr and 14 mTorr, an inductive power is 900 W, a bias voltage is −200 V, and a panel temperature is 70° C.

In FIGS. 4 and 5, the highest etching rate and the highest etching selectivity are obtained when 20% Ar is added to a $CF_4$ gas. In other words, according to the final conditions for etching PbO in the present invention, an etching gas is $CF_4$+20% Ar, a panel temperature is 70° C., an inductive power is 900 W, and a bias voltage is −200 V.

The etching selectivity of PbO according to the present invention will now be described as follows.

To dry etch the thick PbO film of 15 μm, a mask material should be selected properly as described above. Therefore, in the present invention, various metal films are used as a hard mask material and an etching selectivity between the respective metal film and the PbO film has been observed. In the present invention, two process conditions have been used.

According to the first process condition, an etch gas is pure $CF_4$, an inductive power is 900 W, a bias voltage is −200 V, a process pressure is 7 mTorr, and a panel temperature is 70° C. According to the second process condition, an etching gas is $CF_3$+20% Ar, an inductive power is 900 W, a bias voltage is −200 V, a process pressure is 7 mTorr, and a panel temperature is 70° C. Metal layers for the mask film used under the first and second process conditions include Cr, Al, Mo, $Fe_2O_3$, Ti, TiN, and Ni.

Cr is easily removed by a wet etchant because of its patternablity. However, it has been found that Cr having a thickness of 5000 Å or greater, tends to have a tensile stress if formed by electron beam evaporation. For this reason, a peeling has been observed, in which the Cr film is peeled from the panel.

Meanwhile, no peeling or crack has been observed in the Ni film even if the Ni film is deposited on the panel by sputtering with a thickness up to 2 μm. Also, the Ni film has an etching selectivity almost similar to the Cr film. However, the Ni film is not easily removed like the Cr film. In this respect, in the present invention, a double structure Ni/Cr is adopted as a structure of the mask. Consequently, PbO of about 3.6 μm can be etched using a Cr film of 4000 Å as a mask film and the other PbO film of 11.4 μm can be etched using a Ni film of 1.4 μm as a mask film.

Finally, to form the aforementioned capillaries in the PbO film, a PbO film of 15 μm is used as a dielectric layer, and a Cr film of 4000 Å and a Ni film of 1.5 μm are formed on the PbO film as mask layers.

Figure 6:
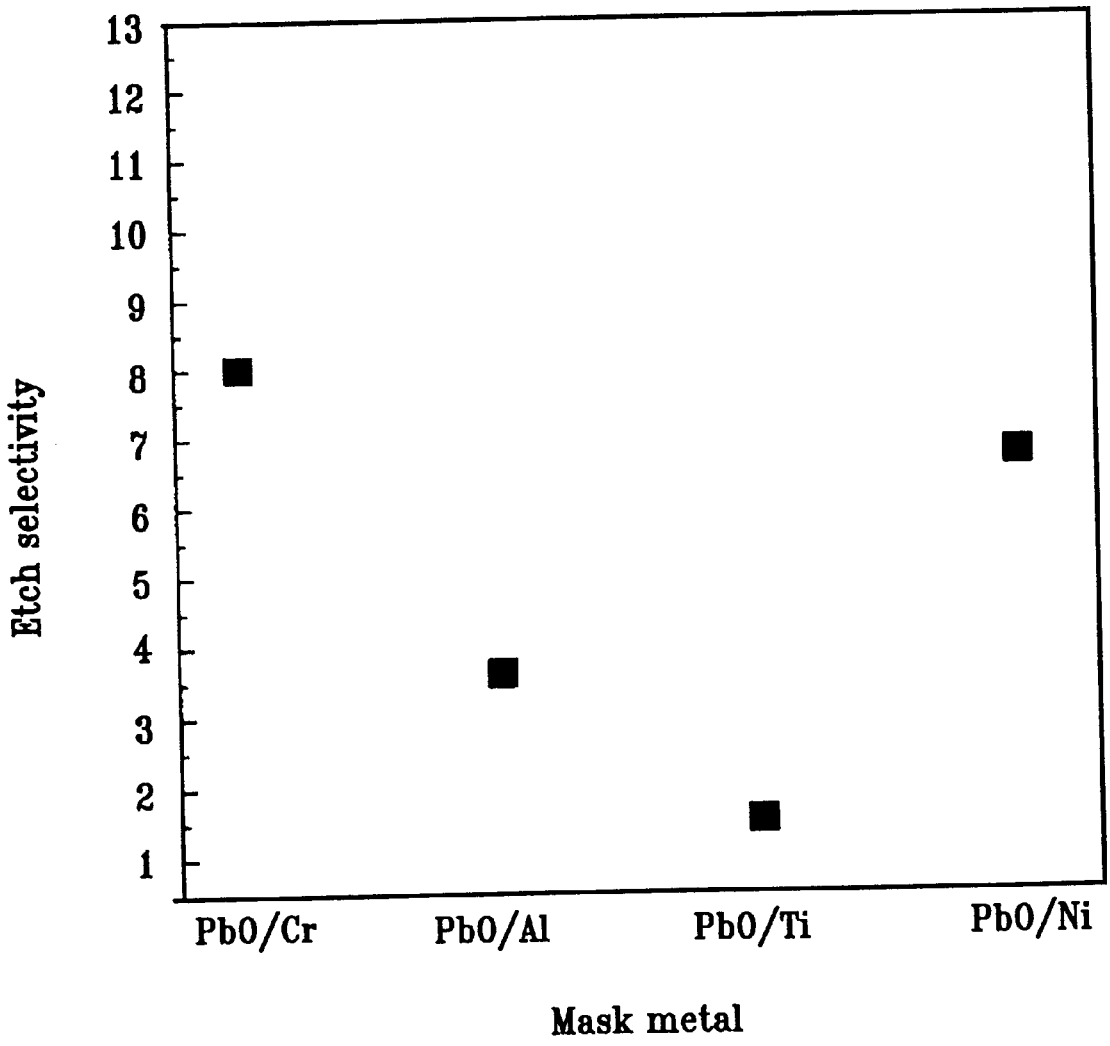
FIG. 6 illustrates variations in etching selectivity of the PbO film when different mask materials are used with a pure $CF_4$ gas as an etching gas.

FIG. 6 is a graph showing variations in etching selectivity of the PbO film according to mask materials when pure $CF_4$ is used as an etching gas.

Figure 7:
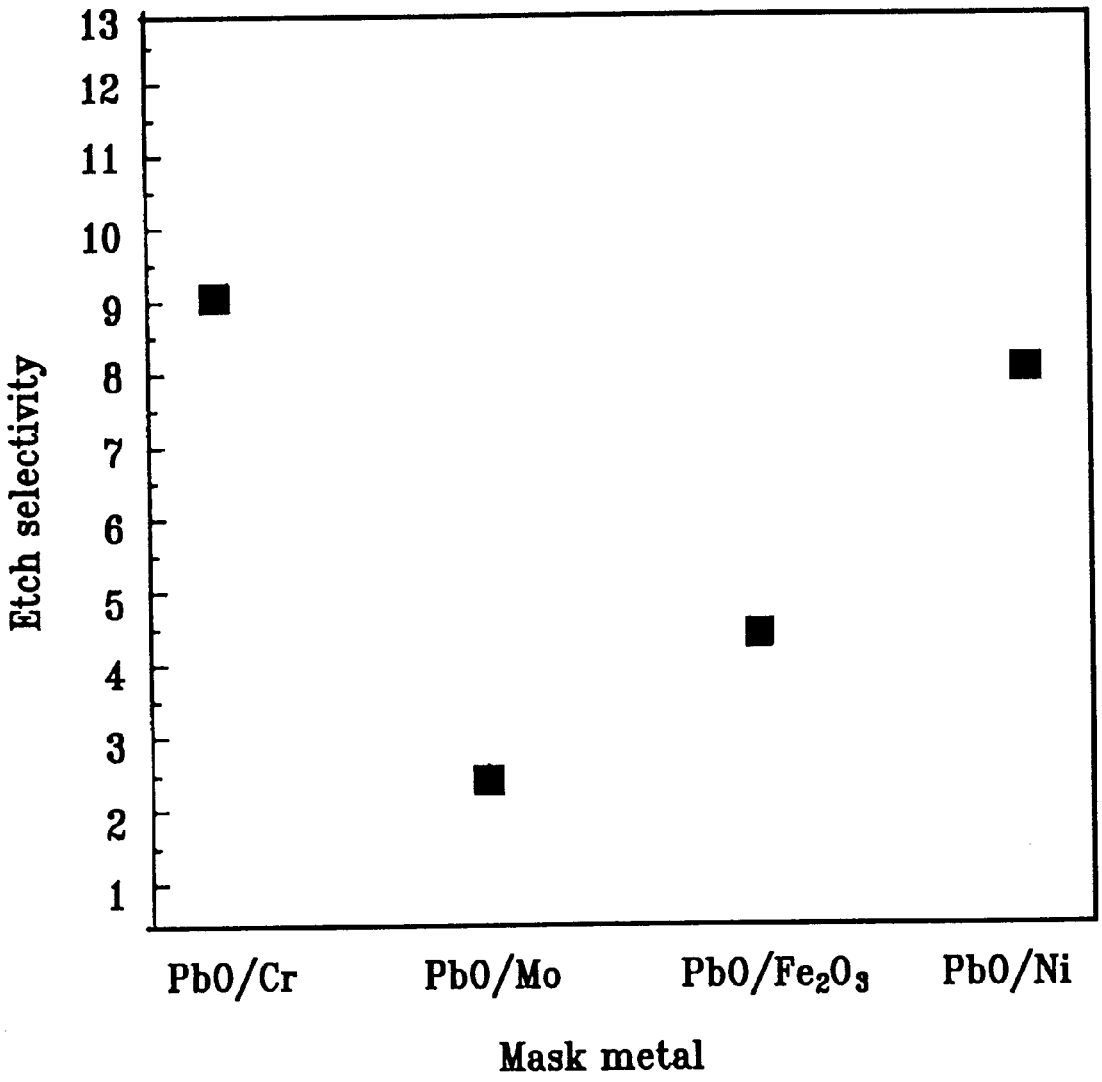
FIG. 7 illustrates variations in etching selectivity of the PbO film when different mask materials are used with 80%$CF_4$+20% Ar as an etching gas.

FIG. 7 is a graph showing variations in etching selectivity of the PbO film according to mask materials when $CF_4$+20% Ar is used as an etching gas.

In FIGS. 6 and 7, other process conditions except for an etching gas are the same. That is, an inductive power is 900 W, a bias voltage is −200 V, a panel temperature is 70° C., and a process pressure is 7 mTorr.

A process for selecting a Ni/Cr film as a mask for the dielectric film of PbO will now be described in detail.

First, a process for patterning a Ni film as a mask film of the PbO film will be described.

To pattern the Ni film, AZ9262 photoresist having a thickness of 6.8 μm has been used. An etching rate of the Ni film has been observed using magnetization induced combination plasma.

FIG. 8 is a table showing variations in an etching rate of the Ni film when the Ni film is etched using magnetization induced combination plasma.

An etching gas of the Ni mask film and the process conditions have been determined using the results of FIG. 8. As final etch conditions, an etching gas is $Cl_2$+20%$BC1_3$ (5 mTorr), a panel temperature is 70° C., an inductive power is 600 W, and a bias voltage is −200 V. Under such conditions, when the etching process is performed on the Ni mask film for about 17 minutes, the Ni film can theoretically be etched by a thickness of 1.5 μm. In this process, an etching rate of a photoresist deposited on the Ni film is 4000 Å per minute.

Figure 9:
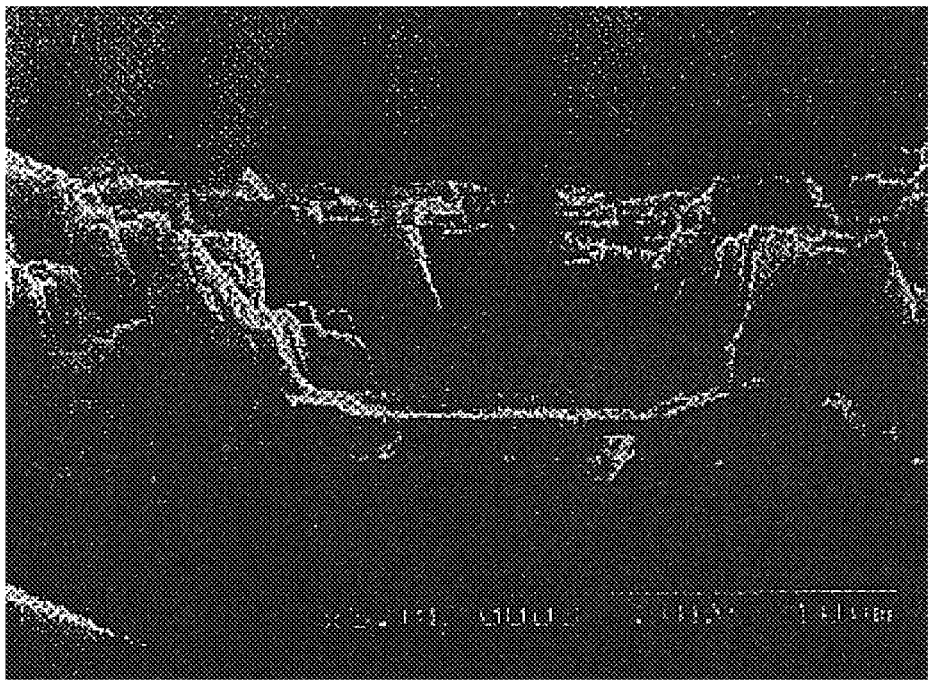
FIG. 9 is a scanning electron microscope (SEM) photograph taken after the Ni film is etched for 20 minutes using a photoresist having a thickness of 6.8 $\mu$m in accordance with the present invention.

However, it has been observed, as shown in FIG. 9, that the Ni film is almost not etched and the photoresist deposited on the Ni film is cracked even if the Ni film is actually etched for 20 minutes or greater under the above conditions. For example, after discumbing is performed using $O_2$, the photoresist has a long tail of a concentric circle shape. Accordingly, it has been observed that the Ni film is not etched as a whole. Here, discumbing is a process for forming a desired shape on the photoresist before etching the Ni film.

FIG. 9 is a SEM photograph taken after the Ni film is etched for 20 minutes using the photoresist having a thickness of 6.8 μm.

Some problems may occur due to a chemical gas used for etching, or due to increase in the panel temperature as the panel temperature increases by 70° C. when the Ni film is etched. Another problem would be related to a hard baking time because of characteristic differences of the photoresist.

To solve the above problems in the present invention, new process conditions are required to form a desired shape of the photoresist mask pattern. Accordingly, a negative photoresist, such as AZ5214E picture inverted photoresist, is used as a mask material of the Ni film. In the present invention, a lift-off process is used as an etching process for forming the Ni/Cr mask pattern instead of a wet-etching process.

Figure 10A:
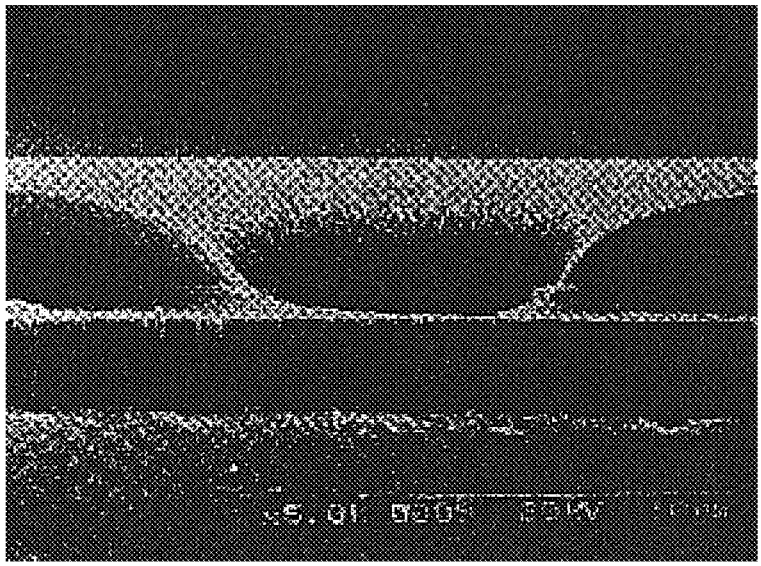
FIGS. 10A and 10B are SEM photographs showing a cross-section of the photoresist having a thickness of 6.8 $\mu$m in accordance with the present invention.
Figure 10B:
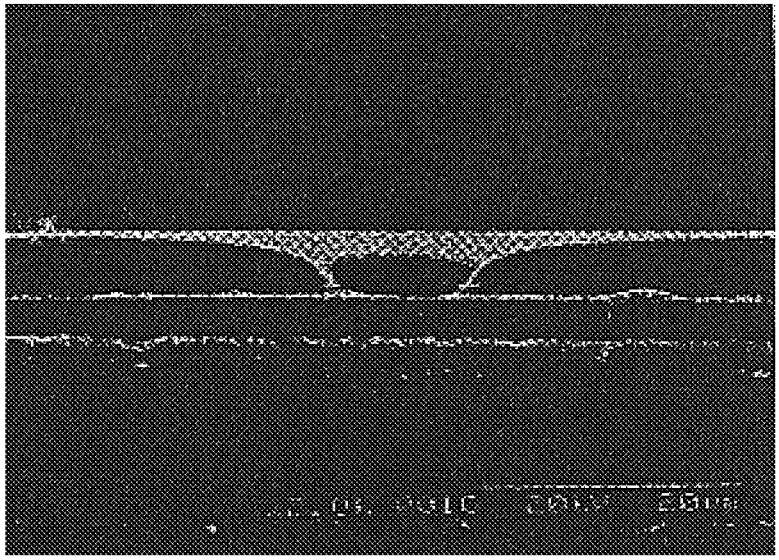

FIGS. 10A and 10B are SEM photographs showing cross-sections of the photoresist having a thickness of 6.8 μm in accordance with the present invention.

FIG. 11 is a table showing process conditions of a polysilicon type photoresist for a picture inversion in accordance with the present invention.

Among the process steps of fabricating the PDP, the process for forming capillaries in PbO according to the present invention will be described in detail.

Under the conditions shown in FIG. 10, a photoresist pattern is formed to pattern the Ni/Cr film. At this time, the AZ 5214E picture inverted photoresist is used as the photoresist.

Figure 12A:
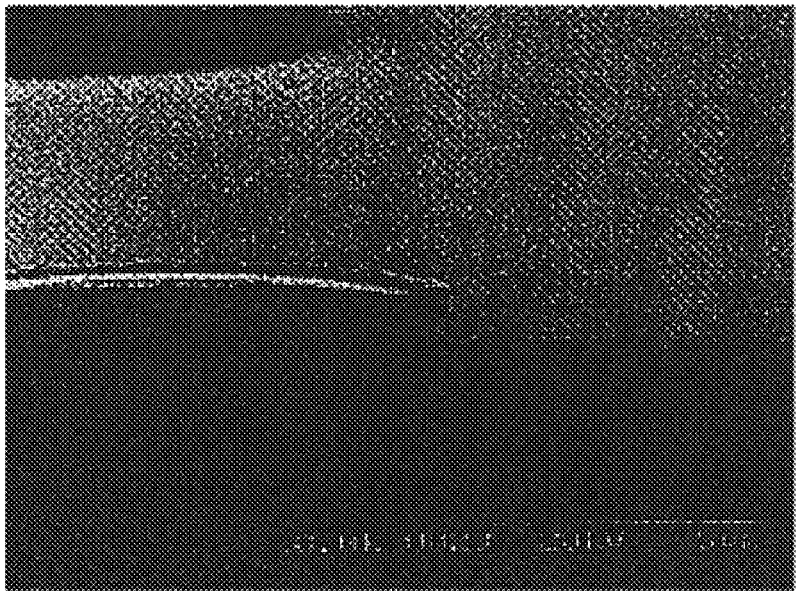
FIGS. 12A and 12B are SEM photographs showing an inverted shape of a hole pattern having a diameter of 10 $\mu$m, in which the AZ 5214E picture inverted photoresist is formed on a silicon panel.
Figure 12B:
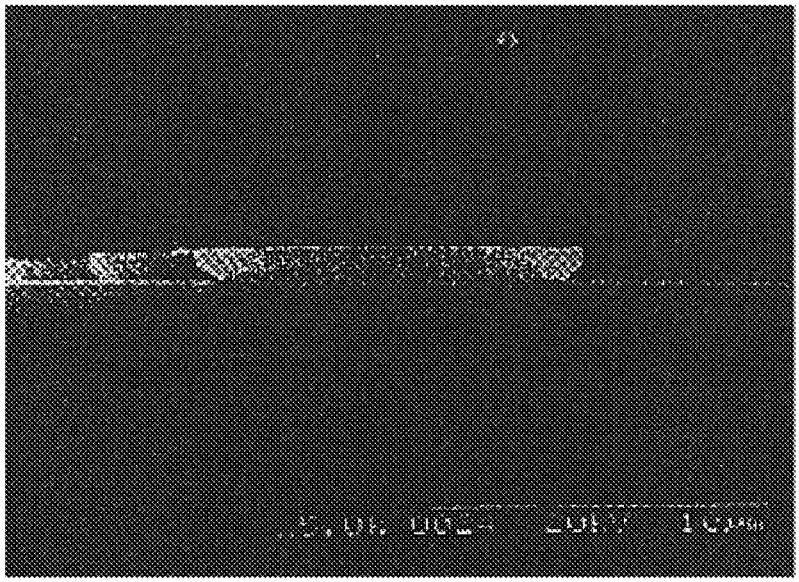
Figure 13:
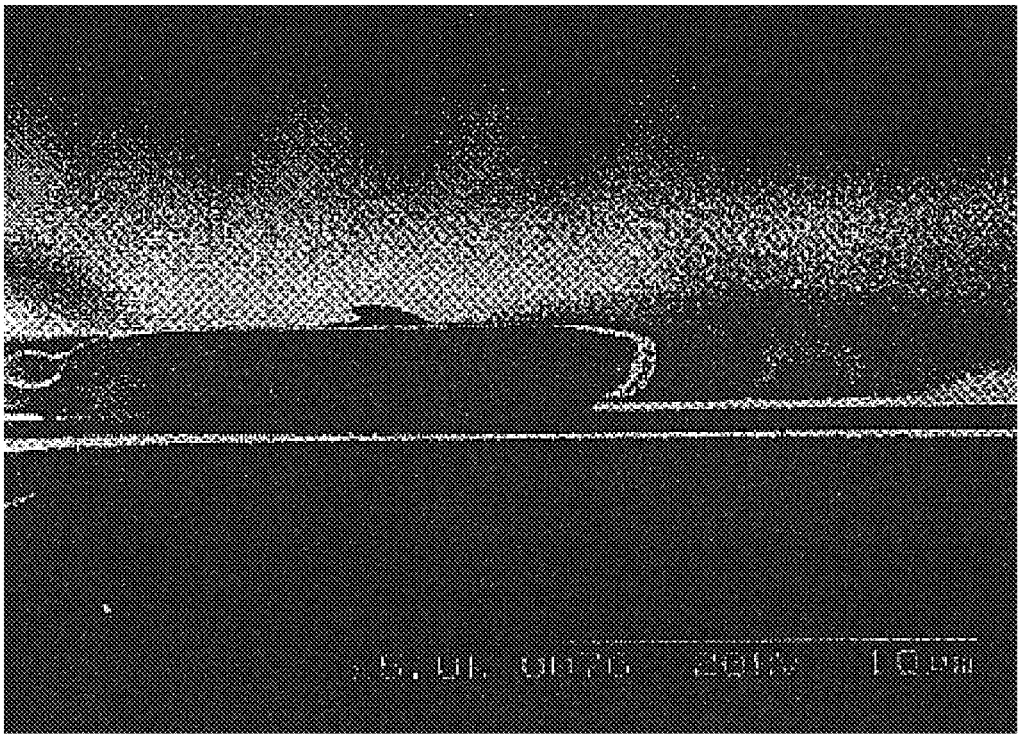
FIG. 13 is an SEM photograph showing an inverted shape of a hole pattern having a diameter of 10 $\mu$m, in which the AZ 5214E picture inverted photoresist is formed on PbO on the glass panel using the process conditions of FIG. 11.

FIGS. 12A and 12B are SEM photographs showing an inverted shape of a hole pattern having a diameter of 10 μm, in which picture inverted AZ 5214E photoresist is formed on the silicon panel. FIG. 13 is an SEM photograph showing an inverted shape of a hole pattern having a diameter of 10 μm, in which the AZ 5214E picture inverted photoresist is formed on PbO deposited on the glass panel using the process conditions of FIG. 11.

In other words, the process conditions of FIG. 13 are obtained on the silicon panel and are applied to PbO deposited on the glass panel.

Figure 14A:
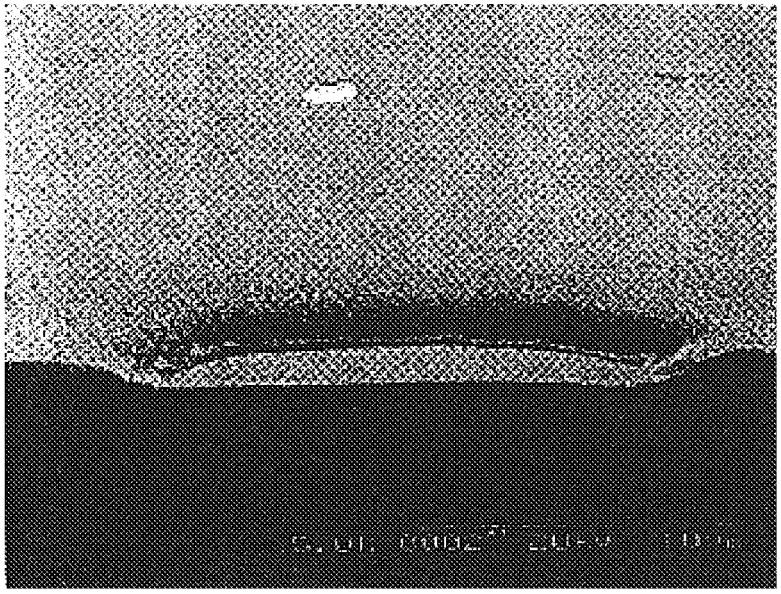
FIGS. 14A and 14B are SEM photographs showing a mask pattern of Ni/Cr for a hole having a depth of 10 $\mu$m.
Figure 14B:
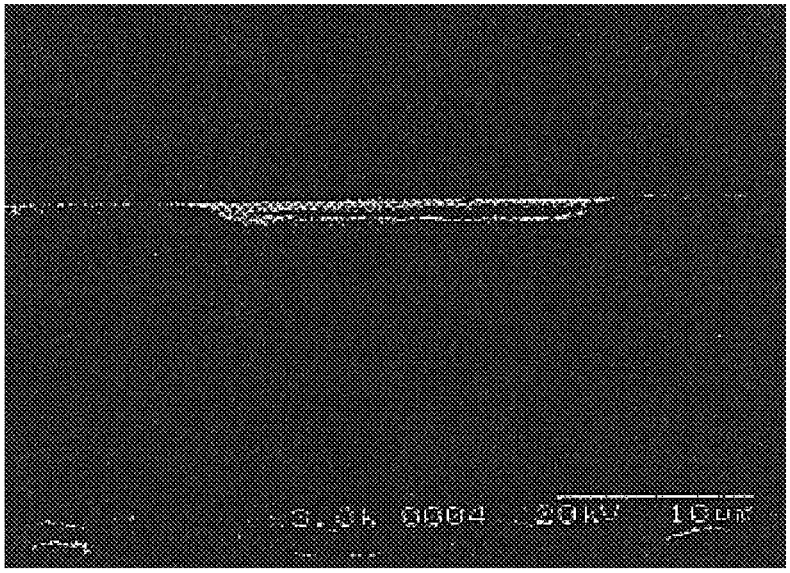

Subsequently, the Ni/Cr film is etched by a lift-off process using the photoresist pattern of FIG. 15 as a mask. Then, a mask pattern of Ni/Cr having a depth of 10 $\mu$m as shown in FIG. 14 is obtained. FIGS. 14A and 14B are a photograph showing the mask pattern of Ni/Cr for a hole having a depth of 10 $\mu$m.

To obtain the pattern of FIG. 14, a PbO layer is deposited on the glass panel, and a Cr film and a Ni film are deposited on the PbO layer. Either the Cr film or the Ni film may be initially formed on the PbO layer. The AZ 5214E picture inverted photoresist pattern is then formed on the Ni/Cr film.

Subsequently, the Ni/Cr film is etched by a lift-off process using an acetonic ultrasonic cleaning. Here, the Cr film is deposited on the PbO layer at a thickness of 1000 Å by an electron-beam evaporation method. The Ni film is deposited on the Cr film having a thickness of 1.1 $\mu$m by sputtering.

Figure 15A:
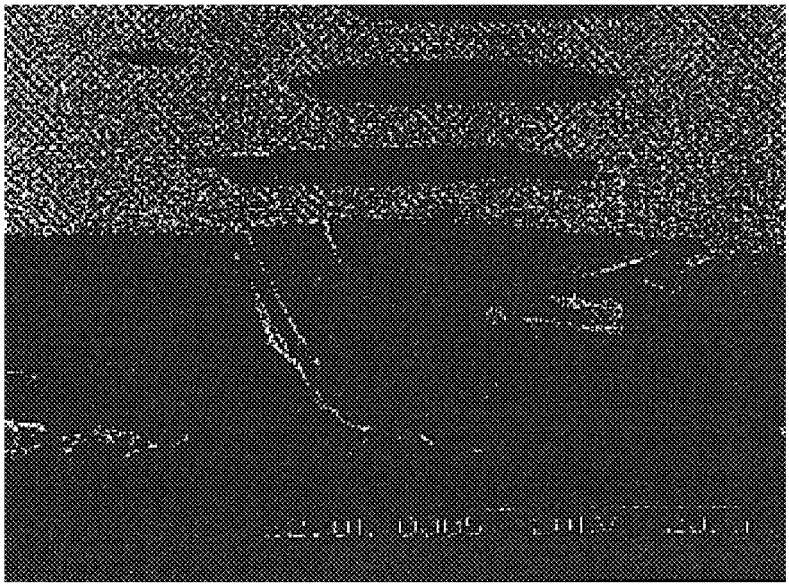
FIGS. 15A and 15B are SEMs photograph showing an actually etched PbO film.
Figure 15B:
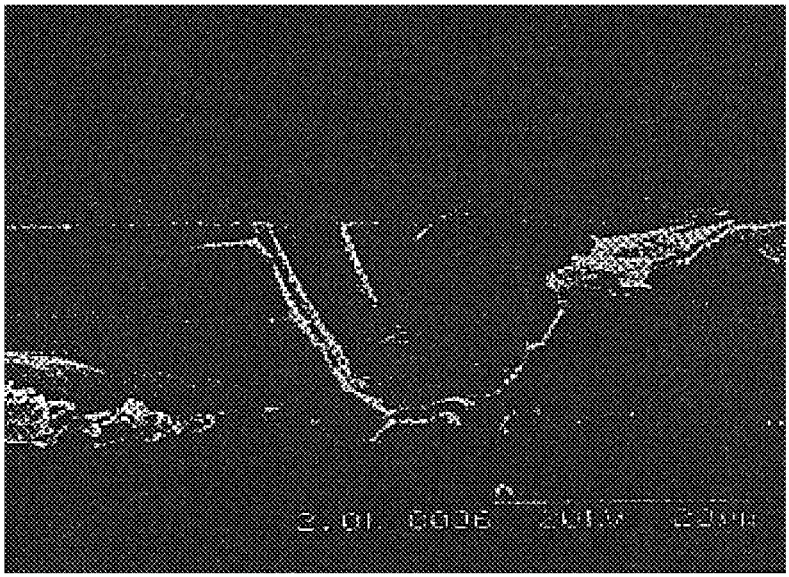

Referring to FIGS. 15A and 15B, a smearing phenomenon is observed, in which the Ni/Cr film is smeared inwardly. This is because the Ni film is deposited by sputtering. A problem related to the smear phenomenon can be solved by using an electron-beam evaporation method rather than the other methods.

Finally, at least one or more desired capillaries are formed within the dielectric layer by etching the PbO film using the Ni/Cr pattern formed by a lift-off process as a mask.

Meanwhile, conditions for etching the PbO film are as follows.

A chemical gas for etching is $CF_4$+20% Ar, an inductive power is 900 W, a bias voltage is −200 V, a process pressure is 7 mTorr, and a panel temperature is 70° C. Under these conditions, when the PbO layer is etched, a hole having a depth of 15 $\mu$m is obtained.

FIGS. 15A and 15B are SEM photographs showing an etched PbO film.

Up to now, the process for forming capillaries in the dielectric layer has been described. Such a process can be applied to fabricating any capillary charge plasma display panels.

FIGS. 16A to 16F illustrate the overall process steps of fabricating capillary charge plasma display panels in the present invention.

Figure 16A:
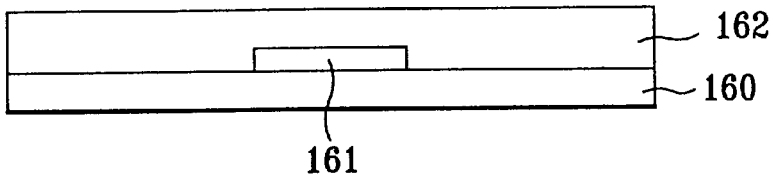
FIGS. 16A to 16F are cross-sectional views illustrating process steps of fabricating a capillary discharge plasma display panel using a lift-off process in the present invention.
Figure 16B:
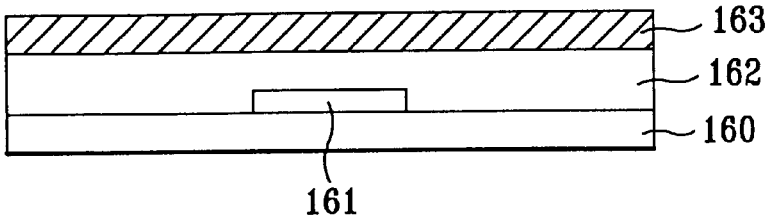
Figure 16C:
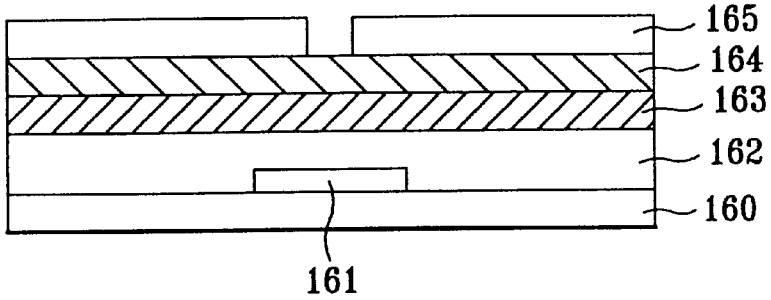
Figure 16D:
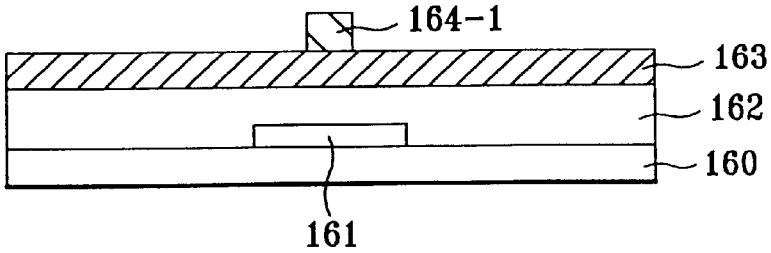
Figure 16E:
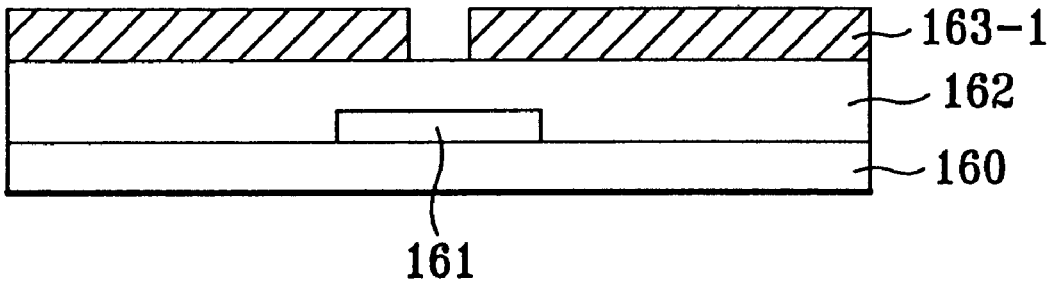
Figure 16F:
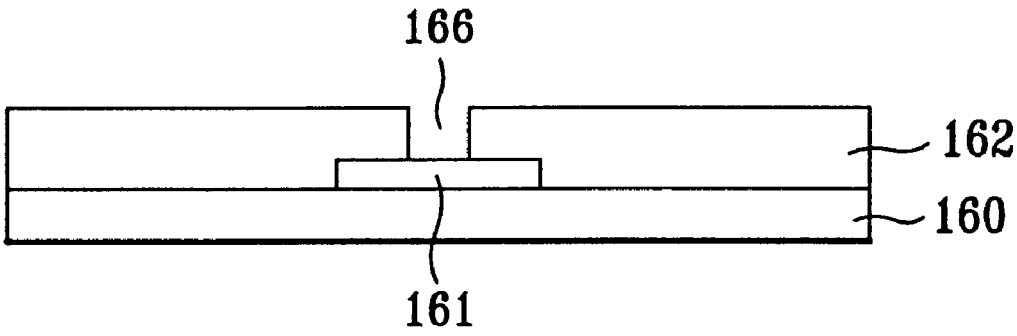

In FIG. 16A, a dielectric layer 161 is formed on a glass substrate 160. A Cr layer and a Ni layer are sequentially deposited on the dielectric layer 161 in FIG. 16B. Thereafter, a negative photoresist film 164 (AZ 5214E) is deposited on the Ni/Cr layer 162. Subsequently, a picture inverted photoresist pattern 165 is obtained by discumbing and developing processes in FIG. 16C. A lift-off process is performed on the Ni/Cr layer 162 using the picture inverted photoresist pattern 164-1 as a mask in FIG. 16D. As a result, a Ni/Cr mask pattern 163-1 is obtained in FIG. 16E. Thus, a capillary is formed in the dielectric layer 161 by etching the dielectric layer 161 using the Ni/Cr mask pattern 163-1 as a mask.

Subsequently, a pair of barriers (not shown) are formed, thereby combining front and rear glass panels. Therefore, a capillary discharge plasma display panel is completed in the present invention.

As aforementioned, the PDP and method for fabricating the same of the present invention has the following advantages.

First, it is possible to stably form the channels formed within the dielectric layer when fabricating the PDP.

Second, since the PDP of the present invention has a simpler structure and better efficiency in generating UV discharge of steady state, the production cost is remarkably reduced.

Third, since no dielectric buried electrode is required, the PDP of the present invention has a simpler structure than the related art PDP.

Finally, since discharge with high electric field is maintained within the capillary tube, higher luminance can be obtained.

It will be apparent to those skilled in the art that various modifications and variations can be made in the method of fabricating a capillary discharge plasma panel display of the present invention without departing from the spirit or scope of the inventions. Thus, it is intended that the present invention covers the modifications and variations of this invention provided they come within the scope of the appended claims and their equivalents.

What is claimed is:

1. A method for fabricating a plasma display panel having first and second panels, the method comprising the steps of:

forming at least one electrode on the first panel;

forming a dielectric layer of PbO on the first panel;

sequentially forming Cr and Ni layers on the PbO layer as a mask of the PbO layer;

performing photolithography and lift-off processes on the Cr and Ni layers to form a mask pattern of the Cr and Ni; and etching the PbO layer using the mask pattern of Ni/Cr to form at least one capillary tube within the PbO layer to expose the electrode.

2. The method of claim 1, wherein the panels are glass substrates.

3. The method of claim 1, wherein the Cr and Ni are deposited by electron-beam evaporation method.

4. The method of claim 1, wherein the Ni layer has a thickness of 1.5 m and the Cr layer has a thickness of 4000 when the PbO layer has a thickness of 15 m.

5. The method of claim 1, wherein the step of forming the mask pattern of Ni/Cr includes the steps of:

depositing a negative photoresist on the Ni/Cr layers and performing the photolithography process to form a picture inverted photoresist pattern of the capillary tube; and performing the lift-off process on the Ni/Cr layers using the photoresist pattern to form the mask pattern of Ni/Cr.

6. The method of claim 5, wherein the negative photoresist is AZ 5214E picture inverted photoresist.

7. The method of claim 1, wherein the PbO layer is etched by dry etching process, and the etching process has conditions such as etch gas of $CF_4$+20% Ar, panel temperature of 70 C., inductive power of 900 W, bias voltage of −200 V, and process pressure of 7 mTorr.

8. The method of claim 1, wherein the Ni layer has a thickness of 1.1 m and the Cr layer has a thickness of 1000 when the PbO layer has a thickness of 10 m.

9. The method of claim 1, wherein the lift-off process is performed using acetonic ultrasonic cleaning.

10. A method for fabricating a PDP comprising the steps of:

preparing a first and second panels;

depositing a dielectric layer on a first panel;

depositing at least one film on the dielectric layer;

forming a photoresist pattern on the film;

performing a lift-off process of the film; and forming at least one channel within the dielectric layer.

11. The method of claim 10, wherein the panels are glass panels.

12. The method of claim 10, wherein at least one electrode is formed on the first panel.

13. The method of claim 10, wherein the dielectric layer is a PbO layer.

14. The method of claim 10, wherein the film is a Cr/Ni film.

15. The method of claim 14, wherein the Cr film is deposited by electron-beam evaporation.

16. The method of claim 14, wherein the Ni film is deposited by sputtering.

17. The method of claim 10, wherein the photoresist pattern is an AZ 5214E picture inverted pattern.

18. The method of claim 10, wherein the lift-off process is performed by acetonic ultrasonic cleaning.

19. The method of claim 10, wherein the at least one channel is formed by etching the layer using the pattern formed by a lift-off process as a mask.

* * * * *